US008617005B2

(12) United States Patent
Moran et al.

(10) Patent No.: US 8,617,005 B2
(45) Date of Patent: Dec. 31, 2013

(54) GOLF DATA COLLECTION

(75) Inventors: Padraic Moran, Galway County (IE); John McGuire, Galway County (IE); William Hunt, Limerick County (IE)

(73) Assignee: Active Mind Technologies R&D Limited, Galway County (IE)

( * ) Notice: Subject to any disclaimer, the term of this patent is extended or adjusted under 35 U.S.C. 154(b) by 219 days.

(21) Appl. No.: 13/031,862

(22) Filed: Feb. 22, 2011

(65) Prior Publication Data

US 2012/0035003 A1 Feb. 9, 2012

(30) Foreign Application Priority Data

Aug. 5, 2010 (IE) ..... S2010/0486

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.

USPC ..... 473/407; 473/199; 473/222; 473/283; 700/92

(58) Field of Classification Search

USPC ..... 473/222, 283, 199, 407; 273/87, 176, 273/34, 178, 129; 700/92; 340/323

See application file for complete search history.

(56) References Cited

U.S. PATENT DOCUMENTS

| | | | | |
|---|---|---|---|---|
| 4,142,236 | A | 2/1979 | Martz et al. | |
| 5,044,634 | A * | 9/1991 | Dudley | 473/169 |
| 5,434,789 | A * | 7/1995 | Fraker et al. | 473/407 |
| 6,030,109 | A | 2/2000 | Lobsenz | |
| 6,582,328 | B2 | 6/2003 | Kuta et al. | |
| 7,118,498 | B2 | 10/2006 | Meadows et al. | |
| 2006/0178110 | A1 | 8/2006 | Nurminen et al. | |
| 2007/0087866 | A1 | 4/2007 | Meadows et al. | |
| 2009/0111602 | A1 * | 4/2009 | Savarese et al. | 473/283 |
| 2009/0233735 | A1 | 9/2009 | Savarese et al. | |
| 2009/0298605 | A1 * | 12/2009 | Wiegers | 473/199 |
| 2010/0144455 | A1 * | 6/2010 | Ahern | 473/222 |
| 2011/0210820 | A1 * | 9/2011 | Talty et al. | 340/5.8 |

FOREIGN PATENT DOCUMENTS

WO 2009009147 A1 1/2009

OTHER PUBLICATIONS

International Search Report and Written Opinion dated Jan. 23, 2012 for International Application Serial No. PCT/EP2011/063074, International Filing Date: Jul. 29, 2011 consisting of 11-pages.

* cited by examiner

*Primary Examiner* — Adetokunbo O Torimiro

(74) *Attorney, Agent, or Firm* — DLA Piper LLP (US)

(57) ABSTRACT

A system for golf data collection comprises an apparatus arranged to be worn about the body of a golfer during a game of golf. The apparatus includes a positioning system for determining various locations of a golfer during the game, a tag reader for reading a club held in close proximity to the apparatus around the time of striking a golf ball, and a processor for correlating the location of the golfer with the time at which a tag is read to enable the path of a golf ball throughout the game of golf to be determined.

18 Claims, 4 Drawing Sheets

GOLF DATA COLLECTION

CROSS-REFERENCE TO RELATED APPLICATION

This application is a claims priority to Irish Patent Application Serial No. S2010/0486, filed Aug. 5, 2010, the entirety of which is incorporated by reference.

STATEMENT REGARDING FEDERALLY SPONSORED RESEARCH OR DEVELOPMENT n/a

FIELD OF THE INVENTION

The present invention relates to a system and method of collecting and managing data relating to a game or practice for a game such as golf.

BACKGROUND OF THE INVENTION

With a view to improving a player's performance, the ability to record appropriate data about a player's game and review/analyse it after the completion of a game would be of great value. In the case of golf, for example, the data recorded could usefully include the specific golf clubs used for each ball strike, the position of the player for each ball strike, the environment that pertained at each ball strike, for example, temperature, humidity, intensity of rain if any, wind speed and direction and time of day. Other data that might be recorded could relate to the condition of the player, for example, heart rate, perspiration level and also details of the swing used for each ball strike. The management of the recorded data can provide useful guidance to a player in the performance of their game. This field is highly developed and many different approaches to gathering such information have been proposed.

WO 2009/009147, Radar Corporation discloses an integrated GPS device & RFID transceiver used with passive RFID tagged golf balls and clubs to enable accurate automatic golf data collection. Reliance on tagging a ball to track the path of the ball around a golf course is common, however, this suffers from the drawback of needing to use non-standard balls which can of course become lost, which may not be permitted in competition and which may be more expensive or perform differently than standard golf balls.

U.S. Pat. No. 6,582,328, Kuta discloses a system comprising a GPS enabled individual subscriber unit for collecting golf game data during a game of golf, and a computer for receiving the golf game data from the individual subscriber unit after the game of golf and for generating a report of the golf game data. Kuta however relies on a user manually inputting club data through a subscriber unit user interface.

U.S. Pat. No. 4,142,236, Martz discloses a similar system except without GPS functionality.

U.S. Pat. No. 7,118,498, Meadows, discloses a GPS enabled PDA allowing a golfer during the course of play to mark a ball location automatically and/or determine the distance to golf course targets and/or objects, and to analyze golf related data and generate statistics.

U.S. Pat. No. 6,030,109, Lobsenz, discloses a golf scoring system in which an acoustic sensor is positioned in close proximity to the location where a golf club strikes a golf ball in connection with a golf shot. A receiver device is provided so as to be in periodic communication with the sensor. Thus, when a player makes a shot, and thus contacts the golf ball with a golf club, the sensor detects the shot and relays information pertaining to that shot to the receiver. The receiver, upon receiving the information, processes the information and displays it for view by the golfer(s) playing the round. The information may also be transmitted to a central location or to other specific locations for centralized, real-time display of golf score, pace and current hole information.

It is an object of the present invention to provide an improved system and method for gathering data in a relatively non-intrusive way during a game or practice for a game, and to provide the ability to review or analyse the data stored some time after the completion of the game with the intention of improving the performance of the player.

SUMMARY OF THE INVENTION

The present invention advantageously provides a method and system for golf data collection.

According to a first aspect of the present invention, there is provided a system for golf data collection comprising an apparatus arranged to be worn about the body of a golfer during a game of golf, the apparatus including: a positioning system for determining various locations of a golfer during said game, a tag reader for reading a club held in close proximity to the apparatus around the time of striking a golf ball, and a processor for correlating the location of the golfer with the time at which a tag is read to enable the path of a golf ball throughout said game of golf to be determined.

The apparatus is arranged to read an identifier from said tag, said identifier being unique to and associated with said golf club. In some embodiments, the identifier may include an indicator of the club type with which said tag is associated.

In one embodiment, the tag reader is arranged to read a tag positioned within approximately 2 cm of said tag reader. In another embodiment, the apparatus as arranged to be worn on a waist of a golfer. In another aspect, the apparatus comprises one of a dedicated portable apparatus, a cell phone, a portable digital assistant (PDA) or portable computing device.

The invention provides an apparatus which can readily record data from a game of golf and allow this data to be reviewed/analysed at the completion of the game.

The apparatus enables the position of the golf player to be identified close to the time at which the striking of a ball takes place and also the specific club selected to strike the ball. The apparatus can store data associated with a multiplicity of ball striking events that occur while the apparatus is powered on.

In accordance with another aspect, a system includes the apparatus and a set of tags, each tag being arranged to be fixed to a respective golf club in a golfer's set of clubs. Further, each tag may be arranged to be applied to the grip of a respective golf club. In one embodiment, each tag has a passive electronic device. In another embodiment, each tag includes an electronic device encapsulated within a housing, where the housing is arranged to be fitted to the top of a golf club.

The apparatus may also include a communication subsystem arranged to transfer data obtained while the apparatus is powered-on to remote non-volatile storage. Preferably, data for one game of golf is arranged to be aggregated with data from other games of golf played by a given player.

In accordance with still another aspect, the system further includes analysis software arranged to access data stored for a golfer and to extract relevant information on a specific game of golf or trends from multiple games of golf for review/analysis. Information extracted may include the number of ball strikes per hole, distance for each shot, type of club used per ball strike, the overall score for a particular game of golf.

In still yet another aspect of the invention, there is provided a system for data collection having an apparatus arranged to be worn about the body of a player practicing a game. The apparatus includes: a positioning system for determining a location of the player during the practice, a tag reader for reading a tag held in close proximity to the apparatus around the time of recovering each of a number of balls struck by the player from a first location, and a processor for correlating the location of the player with the time at which a tag is read to enable the path of said balls from said first location to be determined. The apparatus may be responsive to user interaction to determine a location of the apparatus around the time of the interaction at the first location.

In accordance with another aspect of the invention, there is provided a system for data collection including an apparatus arranged to be worn about the body of a player during a game. The apparatus includes: a positioning system for determining various locations of the player during the game, a tag reader for reading a club held in close proximity to the apparatus around the time of striking a ball, and a processor for correlating the location of the player with the time at which a tag is read to enable the path of a ball throughout said game to be determined.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

Figure 1:
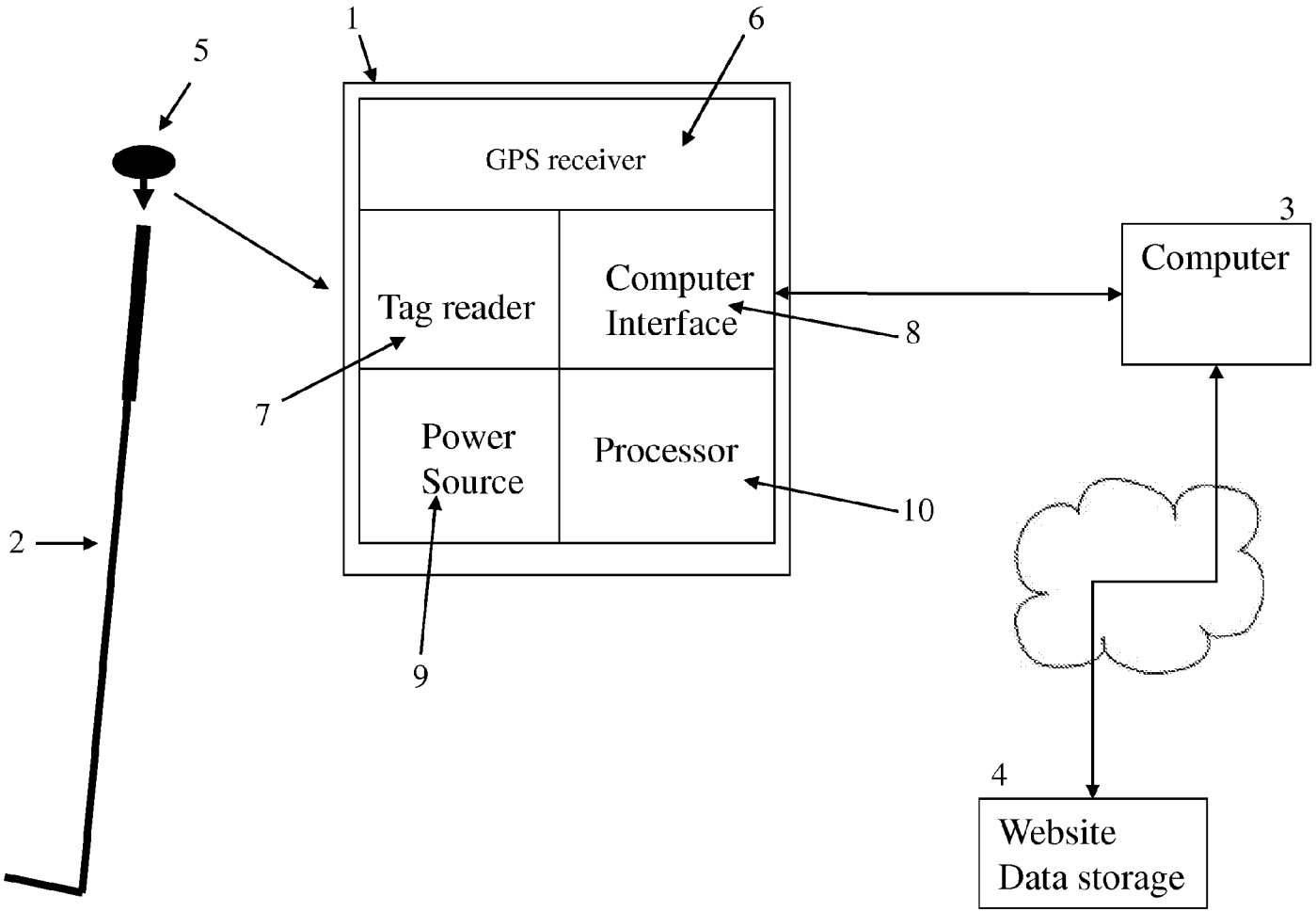
FIG. 1 is a schematic representation of a system for collecting and managing data relating to the game of golf according to an embodiment of the present invention

Referring now to FIG. 1 there is shown a golf data collection system including a portable apparatus 1 according to an embodiment of the present invention. The apparatus is incorporated in a housing suitable for attachment to the belt of the player. This will allow a tag to be readily read as will be described in due course.

Figure 5:
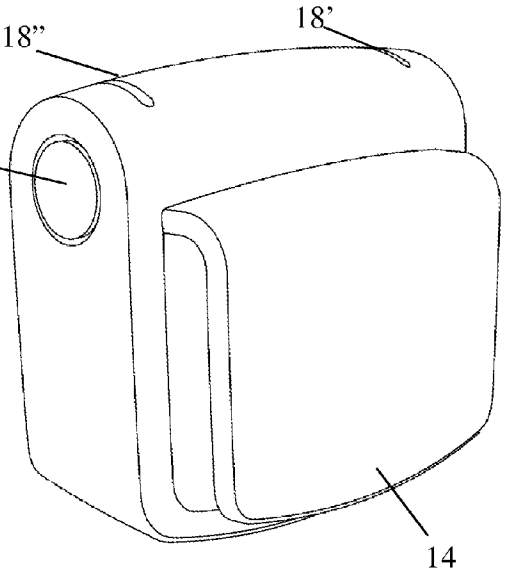
FIGS. 3-5 are various views of a portable apparatus component of the system of FIG. 1.
Figure 4:
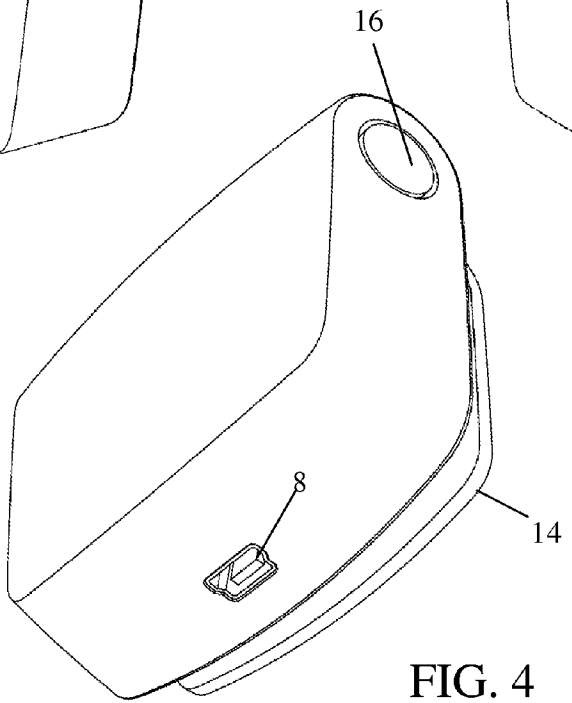
Figure 3:
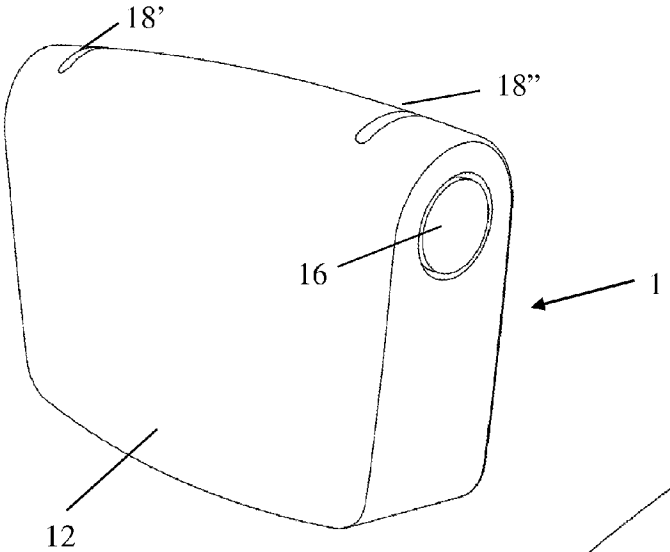

FIGS. 3-5 provide various views of a suitable housing for the apparatus 1. The housing is generally rectangular having a major surface 12 and a reverse surface from which a belt clip 14 extends. A button 16 is provided on a side surface of the housing and this provides a simple, durable interface for a user. In this case, a computer interface 8 in the form of a USB port is provided with a socket on the underside of the housing. One or more additional buttons could equally be provided on the opposite side surface from the button 16. A pair of detents 18', 18" are formed on the upper surface of the housing and these can accommodate either a visible indicator such as a Light Emitting Diode (LED) and/or an audible indicator such as a buzzer, again to provide for a simple and durable user interface.

Internally, the apparatus 1 comprises a GPS receiver 6 for determining a location of the apparatus from an acquired GPS signal, a passive RFID tag reader 7, a processor 10 to control the operation of the apparatus, a power source 9, for example, a rechargeable battery, and the electronics to support the computer interface 8. Preferably, the power source 9 is suitable to power the electronics in the apparatus for at least 6 hours, at least the duration of a game of golf, and suitable batteries include those used for mobile phones. Where the computer interface 8 comprises a USB port, it allows the power source to be recharged as well as enabling the transfer of operating instructions to the processor from a computer 3 and the transfer of data recorded by the apparatus 1 to the computer for example, for storage in a database on a website 4. Other forms of computer interface include infra-red, inductive coupling and RF wireless and these also enable the housing for the apparatus to be hermetically sealed. In any case, information transmitted from the apparatus 1 can include an access code unique to the apparatus and hence a specific player and so can be readily aggregated with other information for that player.

In variants of this embodiment, a Bluetooth transceiver chip (not shown) is also included in the apparatus 1 to enable, for example, additional sensors to be coupled to the apparatus to record: other useful data associated with the striking of a golf ball, information on the playing environment (temperature, wind speed and direction), the condition of the player (heart rate, perspiration), as well as possibly to provide the computer interface 8.

In other variants, the apparatus may include a memory card port for accommodating a removable storage card to which information may be written either by the apparatus 1 before, during or after a game of golf, or by another computer for use by the apparatus before, during or after a game of golf.

In the embodiment, the user interface for the apparatus comprises minimum of control inputs and display outputs, for example, an on/off switch/button such as the button 16, an "end of play" switch/button and LEDs. The LEDs can be used to indicate the status of the apparatus, for example, that it is switched on, the GPS is tracking properly, recording of data is taking place, the battery is healthy.

The apparatus operates with a set of clubs, for example the club 2, each of which carry a passive tag with a unique identification code that can be read by the apparatus 1 when the club is brought in close proximity (preferably not greater than about 2 cm) to the apparatus 1. One example of passive tag comprises an EM4102 transponder produced by EM Microelectronic-Marin SA (EM) and this comprises a chip with dimensions of less than 2 mm2 and which can be encapsulated within a housing 5, FIGS. 6-7. When interrogated by the reader 7, the tag returns a 64 bit code which can be associated with a specific club.

The passive tags operate at between 100 and 150 KHz and preferably at 125 KHz meaning that the separation between tag and reader 7 for reliable reading of the tag ID is not greater than about 2 cm. This distance is sufficient to enable the apparatus to read the ID of the club through whatever weatherproof clothing may be worn by the player over the belt worn by the player to which the apparatus is attached. However, as this separation distance is small, it prevents the apparatus 1 associated with a given golfer mistakenly reading other clubs for the golfer or the golf clubs of other golfers participating in a game of golf.

In one embodiment, the tag is encapsulated within a plastics housing 5, which fits to the top of the grip of a golf club. This means that the tag is not effected by for example the metal shaft of the golf club, nor is it prone to damage when being withdrawn from a golf club bag and perhaps rubbing off of the shafts of other clubs or the body of the body nor does it effect the golfer gripping the club. On the other hand, as the tag housing 5 is located at the top of the club, it is readily coupled to the apparatus 1 worn on the waist of a player and so for reading the club at the time the golfer addresses a ball immediately before (or after) a stroke, so interfering least with the playing of a game of golf.

As such, the housing 5 and apparatus 1 allow the player to easily read the tag at the point of taking a shot, so indicating the location of a ball both at the start of a given shot and in general at the end of a previous shot.

Figure 7:
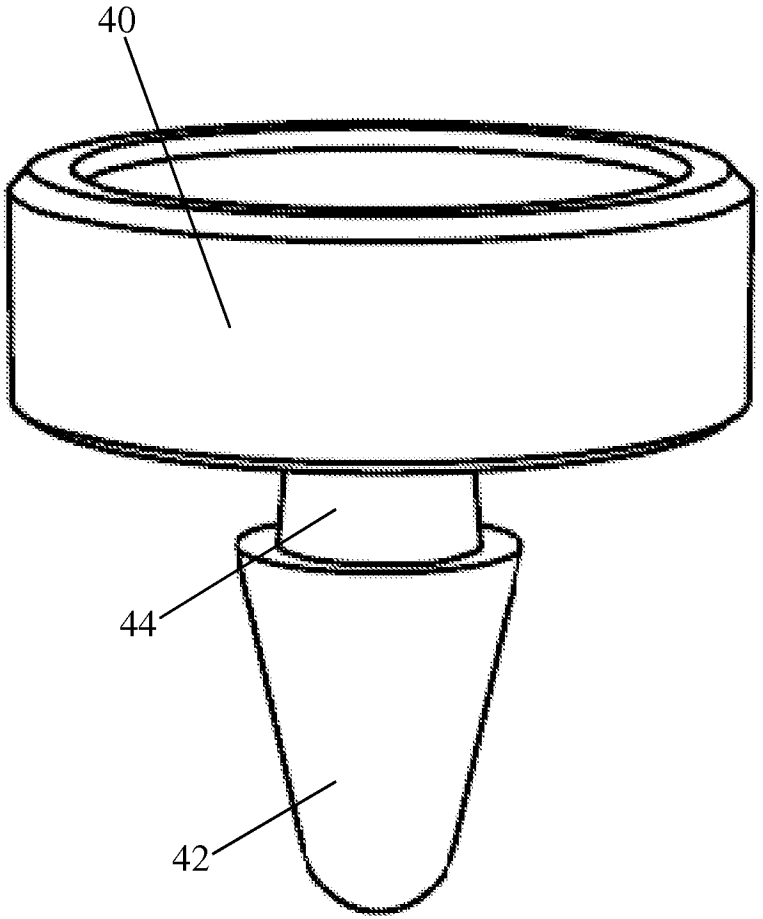
FIGS. 6-7 are various views of a tag housing component of the system of FIG. 1.
Figure 6:
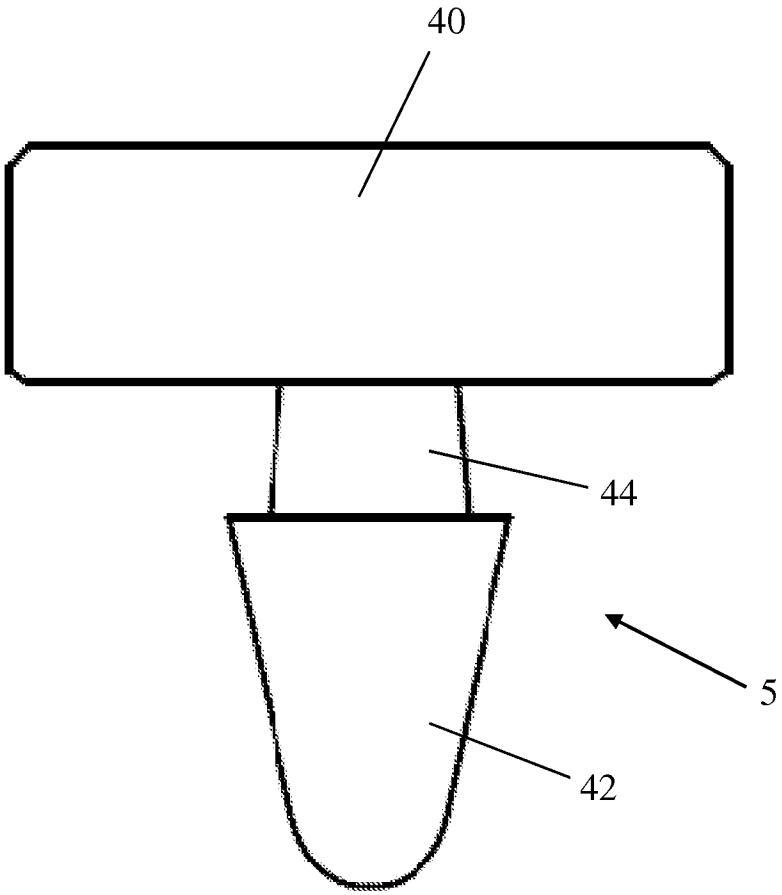

In one embodiment, FIGS. 6-7, the tag housing 5 comprises a generally cylindrical cap 40 having a downwardly depending conical spike 42, between which a narrowed waist 44 is formed. The spike plugs into the hole which is typically formed in the grip of a golf club handle and which is typically used to accommodate a tee or ball marker. In variants of the illustrated embodiment, the tag housing could have a concave under side to secure a closer fit with the convex shape at the top of the grip, and a threaded (probably self tap style) spike, which would be secured by screwing it in to the grip.

Thus, in one form the invention comprises the apparatus 1 and a set of up to 14 or so housings, one for each club in a set of clubs, as well as the computer software to run on the computer 3 to enable communication with the apparatus 1. Preferably, each housing 5 would have indicia printed about the periphery of the cap 40 in the case that the tag ID also were to include a club identity. This would make the task of mapping a set of clubs to a set of tags easier.

The apparatus 1 has two main modes of operation. In a first, when the apparatus is used for the 1$^{st}$ time with a set of non-tagged clubs, the clubs are uniquely identified. The apparatus is connected to a computer 3 via the computer interface 8 and software running on the computer enables the inputting of the description of the clubs e.g. putter, 5 iron, driver, to be loaded onto the computer. Tag housings are inserted into each club grip. Prompted by the instructions generated by the software, the tagged clubs are then brought, in sequence, in close proximity to the apparatus and the unique identification code in each tag is read for each club and stored for reference. On receiving confirmation that the tag code has been successfully read, for example, by an audible tone from the apparatus, the player is prompted to enter, select or confirm as appropriate the description of the club whose tag has just been read. In this way the unique code in each tag is now cross referenced to the club to which the tag is attached and by reading the tag at a later time, the specific club can be uniquely identified.

In any case, it will be appreciated that data relating the club description to the tag ID can either be stored on the user's personal computer, a central computer, within non-volatile memory incorporated in the apparatus either separately or within the processor 10 or within removable storage held within the apparatus.

When the set of clubs in use have been tagged by the apparatus, the apparatus can recognise these codes and the data set (club selected, latitude/longitude, altitude, time, etc.) gathered from the game of golf can be uploaded to the database either on the computer 3 or on a central website 4 using the specific access code associated with the apparatus in use.

In the second mode of operation, as a player starts a game of golf and before they approach their 1$^{st}$ assigned Tee (driving box for a specific hole), the apparatus 1 is switched on. The GPS receiver 6 in the apparatus commences tracking the required number of satellites of the GPS system to get a reliable location of the apparatus (hence player) as reported by its latitude and longitude co-ordinates. Up to 5 minutes may be required to get a confirmation signal from the apparatus that proper tracking by the GPS receiver has been established and that reliable, time stamped, latitude and longitude coordinates and altitude are available.

Once GPS tracking is established, either soon before or after taking the shot, but preferably as the player is addressing the ball, the player moves the selected club and its tag housing used for the 1$^{st}$ ball strike (shot), in close proximity to the apparatus 1 thereby allowing the tag reader 7 of the apparatus to interrogate the tag and read its unique ID code. An audible tone confirms successful club identification.

The apparatus then stores the identification number of the club selected along with the latitude, longitude, tag time information ($t_c$) from the GPS receiver. Any other available information including altitude, temperature, humidity etc can also be stored. As long as proper tracking by the GPS receiver exists, the apparatus continues to store the data set (latitude/longitude/time etc) on a periodic basis, for example, second by second, as the GPS receiver updates its output.

As the player moves through the game of golf, a different club may be selected depending upon the wishes of the player. As each different club is selected and proper identification established, the apparatus correlates the identification code of the selected club with the GPS data set (latitude/longitude/time etc).

As the GPS data set in the apparatus is updated, a chronological log of the position of the apparatus/golfer can be recorded. By correlating the time of tagging a club identifier with this log, a post processing algorithm (preferably executed after the game is completed) can determine the position of the player from the position(s) immediately prior to the tagging time ($t_c$) and the position(s) immediately after the tagging time by way of interpolating the positions between the points in the GPS record. This in turn indicates the resting position of a ball at the beginning of one shot and, with the exception of when teeing off, the end of a previous shot.

Figure 2:
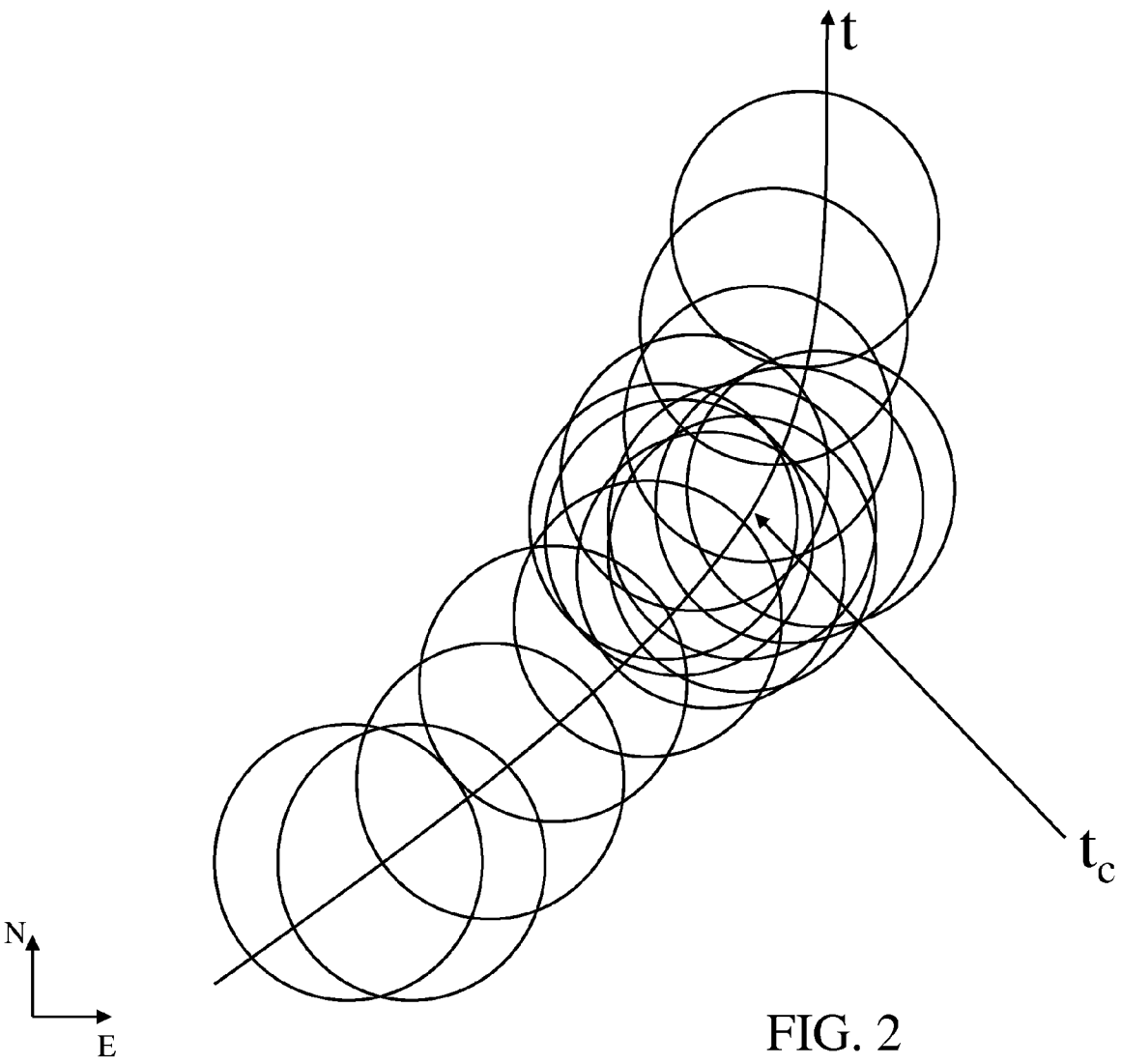
FIG. 2 illustrates a portion of a "crumb trail" of GPS data acquired during a golf game.

As the player moves about the playing area the location of the apparatus is recorded so that a "crumb-trail" is established for the movements of the player, FIG. 2. As can be seen, for any given instantaneous location measurement, the receiver 6 provides the location of a golfer to a given precision, say 3 m2. This means than even when a golfer stands in one position, for example, when addressing a ball at or around tag time, tc, their position when looked at in fine resolution can be seen to vary quasi randomly. However, by appropriately interpolating sequences of measured locations including respective tag times, ball-resting locations can be determined with a greater degree of resolution than from an instantaneous measurement alone. Thus, while not necessarily required to implement the present invention, it is seen as useful to store a record of the golfer's location for more than just at a given time of tagging a club.

The recording of the data set continues until the player signals the "end of game" to the apparatus by pressing an appropriate switch/button. At this time all of the data recorded from the time the 1$^{st}$ club selected was identified is stored in the apparatus.

After the game of golf is completed, the data recorded for the duration of the game can be uploaded to the database on the website 4 using the code associated with the apparatus/player by connecting the apparatus to a computer 3 and using appropriate uploading software.

Additionally an analysis of the "crumb-trail" versus time, after the game has been completed and the data uploaded to the database, can show the apparatus/player was stationary for periods throughout the game and these periods are associated with the lead-up to the striking of the golf ball and sometimes in the aftermath of the ball strike.

Thus, using some or all of these methods the time when the ball strike took place can be established. Knowing the tagging time ($t_c$) corresponds closely with the location and time-of-strike of the ball, the GPS data ("crumb-trail") will show the position of the apparatus/player and hence the golf ball when the ball strike took place.

In variations of the above embodiments, as well as or alternatively to the sensors mentioned above, the apparatus can include or be coupled via Bluetooth with an acoustic sensor, vibration sensor, accelerometer or gyroscope (not shown). This can provide additional data (sound, vibration, acceleration or direction) to be combined with the GPS data set for recording and subsequent up loading to the database on the website and for determining more closely the ball location for each shot. An additional correlated signal from an accelerometer included in the apparatus 1 could also give a signature associated with the striking of the golf ball.

More accurate time-stamping of the ball strike could also be made by detecting the vibration in the handle of the club resulting from the impact of the golf club and the ball at the moment of ball strike.

Post processing of new data and/or previously uploaded data allows useful statistics on the performance of the player to be identified/reviewed and trends in performance established to the satisfaction or not of the player.

In the above embodiments, the apparatus has been described as storing a complete set of coordinates tracking the player's location throughout the game of golf and this can be useful for example in the context of an exercise program subsequently indicating to a golfer the amount of energy they have expended during a game. However, it will be seen that it can be sufficient simply to use the GPS (and possibly other) data gathered immediately before and after the taking of a shot, to determine the location of a ball when struck. Then once determined, the source information can be deleted or possibly overwritten within the apparatus with data for the next shot, so reducing the overall memory requirement for the apparatus 1.

While the embodiment has been described in terms of a dedicated portable apparatus 1, it will also be seen that the invention could be implemented with a general purpose GPS enabled mobile phone, PDA or computing device coupled to or incorporating an appropriate RFID reader. Indeed some mobile phones, for example, a Nokia 6310, now include NFC (near field communications) enabling them to read some forms of RFID tags. These tags are typically more expensive than the tags mentioned above and so are not necessarily as desirable.

While the above described passive tags involve some electronic circuitry and are readily arranged to be read when in close proximity to a tag reader such as described, and so interfering least with the progress of a golf game, it will be seen that other forms of passive tag could also be used. For example, by using a suitably programmed portable apparatus including a bar code reader, golf clubs with appropriate bar codes placed generally in the vicinity of the top of the club could be used in certain implementations of the invention. Alternatively, a camera-enabled device equipped with suitable image processing software could be employed to visually identify a club tag—such technology is now available in some smart-phones.

It will be appreciated that in normal play, when a hole is complete, a player lifts the ball (from the hole) and carries the ball to the next tee location and so the start location for that shot does not correspond with the end location of the previous shot. Similarly, if a ball has been lost or dropped, the start location for the next shot will not be the end location for a previous shot. It can therefore be desirable to record a non-continuous segment in the path of a ball during the game. There are many methods within the scope of the present invention for handling and determining such transitions. In explicit methods, a player might need to, for example, either double tag a club in quick succession (as in mouse double-click) or possibly double-click a switch/button on the apparatus 1 to indicate the end of a hole and so that when a club is tagged next, it is assumed that this is at the beginning of the next hole. Similar user interface paradigms can be used to indicate a hole has been aborted. In implicit methods, tracked locations for a player can be combined with course map information so that for example, when a player tags a putter on a green and subsequently tags a club on a tee box, it is assumed that they had finished the last hole with the last tagged shot and had begun the next hole. Similar approaches can be taken for foul shots without departing from the scope of the invention.

In addition to the modes described above, additional modes can also be provided for the apparatus 1. For example, in one practice mode, selected through appropriate interaction with the apparatus interface, a player first of all reads a tag from a club at a practice location, for example, a bay in a driving range. Then, after the player has struck a number of balls with the club, the player when recovering each ball, actuates the apparatus 1 at the location of each ball. This actuation can be either by way of clicking a switch/button on the apparatus or possibly reading a tag from the club at each position the club is used to scoop up a ball. In any case, the apparatus then determines the location of the apparatus (and thus by implication the ball) at each actuation location. Then by analysing the difference between the first striking location and the actuation (landing) location for each ball, a player's performance with a given club can be reviewed for example, for distance, consistency and accuracy. It will be seen that this practice mode can be employed for different sports involving a player indicating a first location from which a succession of strikes/shots will be made and to subsequently locate the resting place of the balls from those strikes/shots. Such sports include but are not limited to baseball, cricket, free-taking in football/hurling, penalty taking in rugby etc.

In other variants of the above described embodiments, it could be useful for the apparatus to provide audible messages to a golfer during the game or after tagging a club, for example, confirming that a club of a given type has been selected, confirming that a hole is regarded as completed or that a new hole is beginning. These messages could even be customised for a given golfer, for example, when out of competition or conforming with the rules of competition, to provide the golfer with a tip for using a given club or even to discourage a golfer from using a given club in a given location, for example, a driver from the rough. Such audible messages can be relayed to the player using a Bluetooth earpiece, normally employed for hands-free operation of a mobile phone.

Unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A system for golf data collection, comprising:

an apparatus arranged to be worn about the body of a golfer during a game of golf, the apparatus including:

a positioning system for determining various locations of the golfer during said game;

a passive tag reader for reading a club tag only when held in close proximity to the apparatus around a time of striking a golf ball, the passive tag reader operating at a frequency of between 100 KHz and 150 KHz; and a processor for correlating a location of the golfer with a time at which the club tag is read to enable striking and resting locations of the golf ball throughout said game of golf to be determined.

2. The system as claimed in claim 1, wherein said apparatus is arranged to read an identifier from said club tag, said identifier being unique to and associated with said club tag.

3. The system as claimed in claim 2 wherein the identifier includes an indicator of a club type with which said club tag is associated.

4. The system as claimed in claim 1, wherein said tag reader is arranged to read a club tag only when the club tag is positioned within approximately 2 cm of said tag reader.

5. The system as claimed in claim 1, wherein the apparatus as arranged to be worn on a waist of a golfer.

6. The system as claimed in claim 1, wherein the apparatus comprises one of a dedicated portable apparatus, a cell phone, a portable digital assistant (PDA) or portable computing device.

7. The system as claimed in claim 1 further comprising a set of club tags, each club tag being arranged to be fixed to a respective golf club in a golfer's set of clubs.

8. The system as claimed in claim 7, wherein each club tag is arranged to be applied to the grip of a respective golf club.

9. The system as claimed in claim 7, wherein each club tag comprises a passive electronic device.

10. The system as claimed in claim 7, wherein each club tag comprises an electronic device encapsulated within a housing, said housing being arranged to be fitted to the top of a golf club.

11. The system as claimed in claim 1, wherein the apparatus further includes a communication sub-system arranged to transfer data obtained while the apparatus is powered-on to remote non-volatile storage.

12. The system as claimed in claim 11 wherein data for one game of golf is arranged to be aggregated with data from other games of golf played by a given player.

13. The system as claimed in claim 1, wherein the system further comprises analysis software arranged to access data stored for a golfer and to extract relevant information on a specific game of golf or trends from multiple games of golf for review or analysis.

14. The system as claimed in claim 13, wherein information extracted includes number of ball strikes per hole, distance for each shot, type of club used per ball strike, and an overall score for a particular game of golf.

15. The system as claimed in claim 1 wherein said apparatus is operable in a practice mode, wherein the apparatus is responsive to user interaction to determine a location of the apparatus around the time of said interaction as a first striking location and wherein the processor is arranged to record a location of the apparatus for a plurality of subsequent club tag readings enabling the respective resting locations of a number of shots struck from said first striking location to be determined.

16. A system for data collection, comprising:

an apparatus arranged to be worn about the body of a player practicing a game, the apparatus including:

a positioning system for determining a location of the player during said practice;

a passive tag reader for reading a club tag only when held in close proximity to the apparatus around a time of recovering each of a number of balls struck by the player from a first striking location, the passive tag reader operating at a frequency of between 100 KHz and 150 KHz; and a processor for correlating the location of the player with a time at which the club tag is read to enable resting locations of said balls struck from said first striking location to be determined.

17. The system as claimed in claim 16, wherein said apparatus is responsive to user interaction to determine a location of the apparatus around a time of said interaction as said first location.

18. A system for data collection, comprising:

an apparatus arranged to be worn about the body of a player during a game, the apparatus including:

a positioning system for determining various locations of the player during said game;

a passive tag reader for reading a club tag only when held in close proximity to the apparatus around a time of striking a ball, the passive tag reader operating at a frequency of between 100 KHz and 150 KHz; and a processor for correlating a location of the player with a time at which club tag is read to enable striking and resting locations of a ball throughout said game to be determined.

* * * * *